US008572804B2

(12) United States Patent
Tran et al.

(10) Patent No.: US 8,572,804 B2
(45) Date of Patent: Nov. 5, 2013

(54) VACUUM CLEANER WITH MODULAR CLUTCH ASSEMBLY

(75) Inventors: Phong Hoang Tran, Caledonia, MI (US); Gary A. Kasper, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 190 days.

(21) Appl. No.: 13/176,924

(22) Filed: Jul. 6, 2011

(65) Prior Publication Data

US 2012/0005857 A1 Jan. 12, 2012

Related U.S. Application Data

(60) Provisional application No. 61/361,901, filed on Jul. 6, 2010.

(51) Int. Cl.
*A47L 5/10* (2006.01)

(52) U.S. Cl.
USPC ..... 15/390; 15/332; 192/93 A

(58) Field of Classification Search
USPC ..... 15/390, 372, 365, 332, 389; 192/92, 192/93 A
See application file for complete search history.

(56) References Cited

U.S. PATENT DOCUMENTS

| | | | | | |
|---|---|---|---|---|---|
| 2,140,143 | A | * | 12/1938 | Sellers et al. | 15/332 |
| 2,253,309 | A | * | 8/1941 | Smellie | 15/332 |
| 2,287,923 | A | * | 6/1942 | White | 15/370 |
| 2,601,698 | A | | 7/1952 | Humphrey | |
| 4,357,730 | A | | 11/1982 | Lex | |
| 4,446,595 | A | | 5/1984 | Nakada et al. | |
| 5,839,160 | A | | 11/1998 | Wang et al. | |
| 7,228,593 | B2 | | 6/2007 | Conrad | |
| 2008/0185252 | A1 | | 8/2008 | Sandberg | |
| 2009/0089958 | A1 | * | 4/2009 | Dant et al. | 15/332 |
| 2010/0299867 | A1 | | 12/2010 | Beskow et al. | |
| 2010/0299868 | A1 | | 12/2010 | Beskow et al. | |

FOREIGN PATENT DOCUMENTS

| | | | |
|---|---|---|---|
| EP | 1052923 | B1 | 3/2006 |
| EP | 1736088 | A2 | 12/2006 |
| GB | 463408 | | 3/1937 |
| GB | 513087 | | 10/1939 |
| GB | 2271275 | A | 4/1994 |
| GB | 2343107 | A | 3/2000 |
| GB | 2414383 | A | 11/2005 |
| GB | 2447755 | A | 9/2008 |
| GB | 2447755 | B | 2/2009 |
| GB | 2468908 | A | 9/2010 |
| GB | 2468909 | A | 9/2010 |
| WO | 2005107553 | A1 | 11/2005 |

* cited by examiner

*Primary Examiner* — Mark Spisich
*Assistant Examiner* — Andrew A Horton
(74) *Attorney, Agent, or Firm* — McGarry Bair PC

(57) ABSTRACT

A vacuum cleaner comprises a user-controllable clutch assembly for selectively engaging an agitator assembly. The clutch assembly generally comprises an axially displaceable drive member that is selectively engageable by rotating ramps that engage stationary cam lobes. In one embodiment, the clutch module is mounted to the foot housing and is intermediately connected between the vacuum motor/fan shaft and the agitator. In a second embodiment, the clutch module is mounted axially on the agitator shaft. In a third embodiment, a linkage interconnects a handle detent pedal to the clutch module to automatically engage the clutch when a user depresses the detent pedal.

20 Claims, 15 Drawing Sheets

VACUUM CLEANER WITH MODULAR CLUTCH ASSEMBLY

CROSS-REFERENCE TO RELATED APPLICATIONS

This application claims priority to U.S. Provisional Patent Application Ser. No. 61/361,901, filed Jul. 6, 2010, which is incorporated herein by reference.

BACKGROUND OF THE INVENTION

Vacuum cleaners typically utilize a rotating agitator configured to release and propel dust and dirt into a working airflow that is introduced to a downstream separator whereupon the entrained dust and dirt is expelled from the working airflow and collected in a downstream dirt collector in a conventional manner. Vacuum cleaner agitators can be driven by a belt operably connecting a drive pulley on the vacuum motor/fan shaft to a driven brush pulley on the agitator body. In this configuration, the agitator is driven continuously when the vacuum motor/fan is energized. Alternatively, a separate, independently energizable brush motor can be configured to selectively drive the agitator independent of the vacuum motor; however, this configuration adds cost and complexity to the vacuum cleaner design. Single motor vacuum cleaners can utilize a clutch assembly mounted between the vacuum motor/fan for selectively engage and disengaging an agitator in contact with the cleaning surface.

BRIEF SUMMARY OF THE INVENTION

According to the invention, a vacuum cleaner comprises a base assembly having a housing, a suction nozzle, an agitator rotatably mounted to the housing a motor; and a clutch assembly in driven relationship to the motor and in a driving relationship to the agitator for rotatably driving the agitator. The clutch assembly comprises a clutch body, a clutch plate having a friction pad and rotatably mounted to the clutch body, a backing plate juxtaposed to the clutch plate in facing relationship thereto and rotatably mounted through the clutch body. The clutch plate and the backing plate are axially movable with respect to one another between a first position wherein the clutch plate and backing plate are frictionally joined to one another, and a second position wherein the clutch plate and backing plate are separated from one another. A spring mechanism is configured to bias the clutch plate and the backing plate to the second position. In addition, a clutch actuation mechanism is aligned with the clutch plate and the backing plate to selectively move the clutch plate and the backing plate into the first position.

In one embodiment, the clutch assembly can further comprise a shaft which is rotatably mounted to the clutch body. The clutch body, the backing plate, the spring mechanism, and the clutch actuation mechanism can be mounted on the shaft; and retainers are mounted on both ends of the shaft. Further, axial forces generated by compression of the spring mechanism when the clutch plate and backing plate are moved between the first and second positions are contained within the clutch assembly by the retainers, and the axial forces are isolated from the housing.

In another embodiment, the clutch actuation mechanism includes complementary ramped surfaces which are rotationally related to one another to push the clutch plate and the backing plate into the first position in one relative rotational position of the ramps, and to move the clutch plate and the backing plate into the second position in another relative rotational position of the ramps.

In yet another embodiment, the clutch actuation mechanism comprises a lever arm positioned for manual actuation by a user for moving the clutch actuation mechanism between the two relative rotational positions. In still another embodiment, the complimentary ramped surfaces can be positioned on juxtaposed faces of the lever cam and the clutch body.

In yet another embodiment, the clutch assembly is configured as a unitary module and is mounted to the housing as a unit.

In another embodiment, the clutch plate and the backing plate are conically shaped.

In addition, a resettable detent mechanism can be positioned between the lever arm and the housing and configured to retain the lever arm in a rotational position corresponding to the first position of the clutch plate and backing plate. Further, the resettable detent mechanism can be a push-push detent.

DESCRIPTION OF EMBODIMENTS OF THE INVENTION

Figure 1:
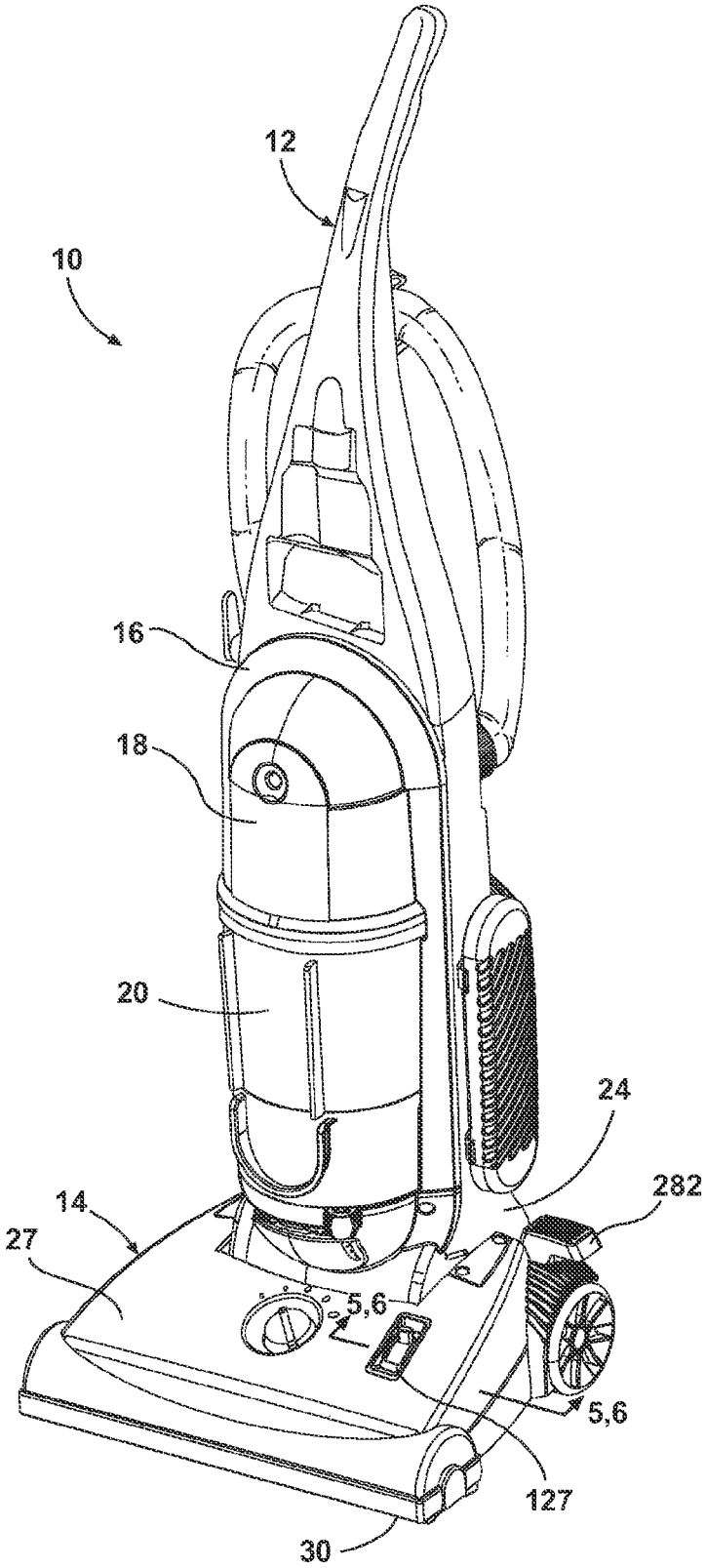
FIG. 1 is a front perspective view of a vacuum cleaner with a clutch assembly according to a first embodiment of the invention.
Figure 2:
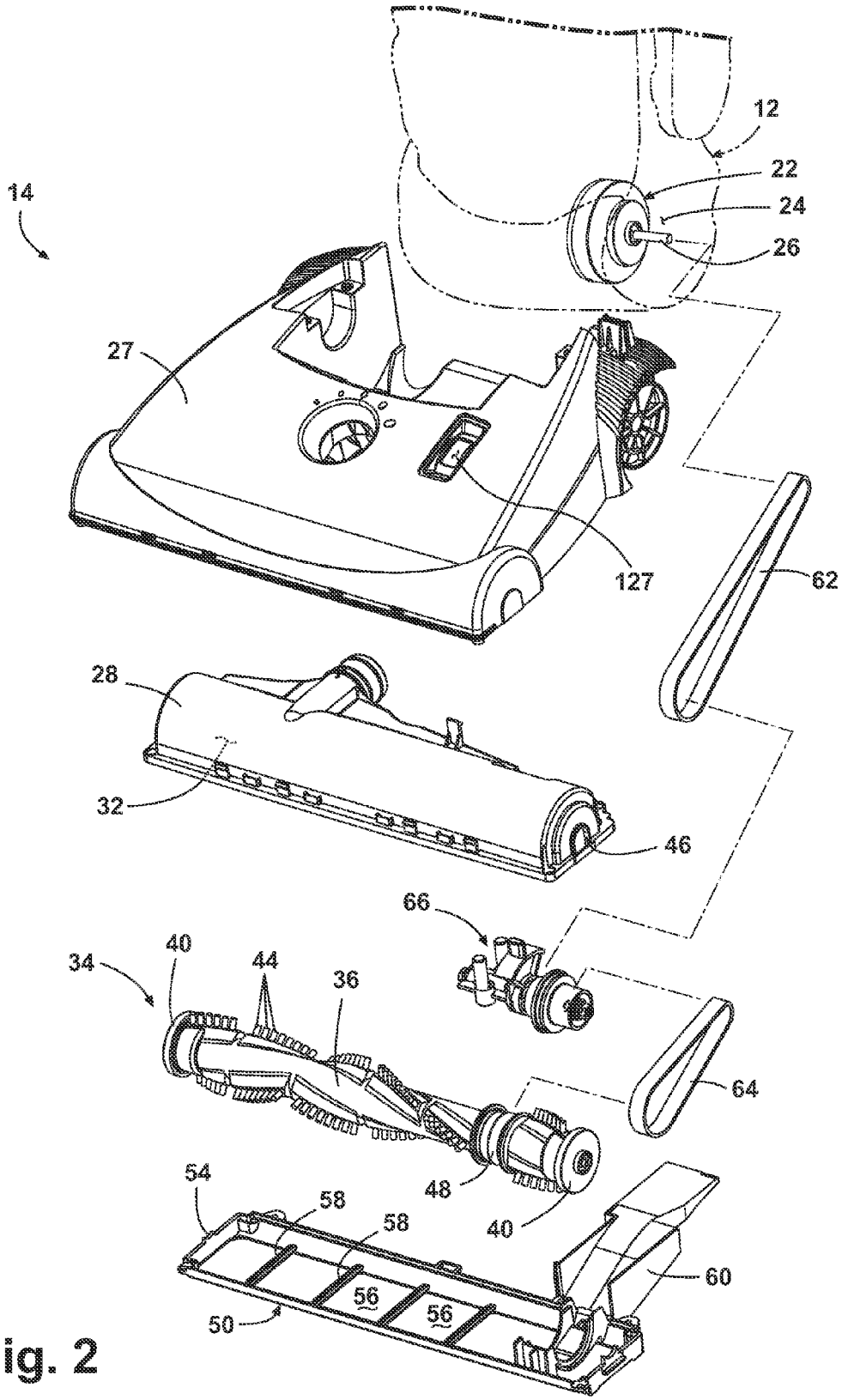
FIG. 2 is a partial exploded view of a foot assembly of the vacuum cleaner of FIG. 1.
Figure 3:
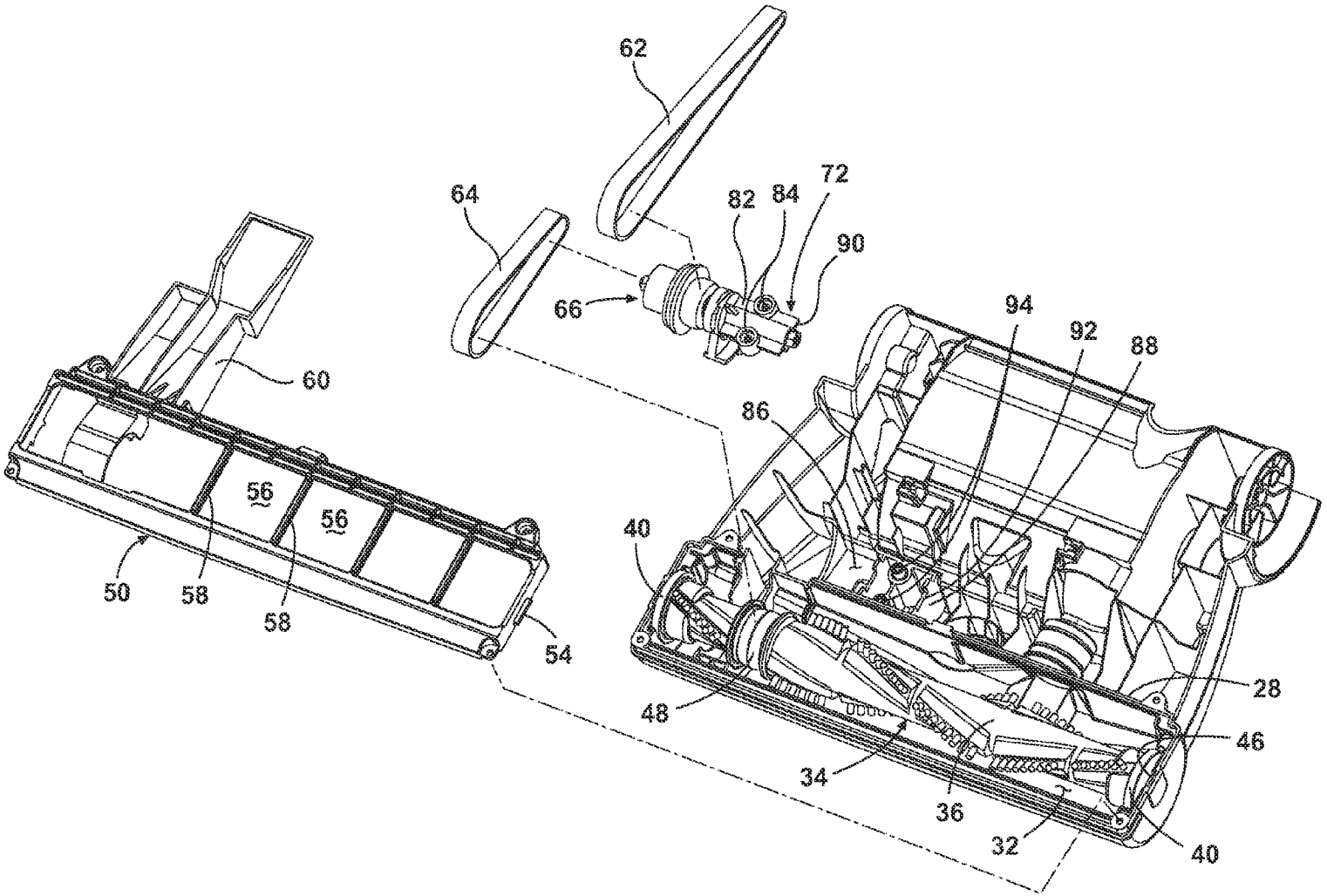
FIG. 3 is a bottom, partial exploded view showing the underside of the foot assembly of FIG. 2.

Referring to the drawings, and in particular to FIGS. 1-3, a vacuum cleaner 10 according to a first embodiment of the invention comprises an upright handle assembly 12 pivotally mounted to a foot assembly 14. The upright handle assembly 12 comprises a main body 16 that houses a separator 18 configured to separate dust entrained in a working airflow. A dirt collector 20 is selectively mounted beneath the separator 18 to collect the dust separated from the working airflow. A suction source is mounted within the lower portion of the upright handle assembly 12 to generate a working airflow through the system, as is commonly known in the art. The suction source comprises a conventional motor/fan assembly 22 that is mounted transversely within a motor chamber 24 and oriented so its motor shaft 26 is substantially parallel to the cleaning surface.

The foot assembly 14 comprises a top cover 27 configured to receive a brush housing insert 28 mounted beneath a forward portion thereof. The brush housing insert 28 defines a suction nozzle opening 30 along the bottom side, and further comprises a brush mounting recess 32 formed therein. The suction nozzle opening 30 is fluidly connected to the suction source via a working airpath (not shown). An agitator 34 is configured for mounting within the brush mounting recess 32. The agitator 34 comprises a brushroll assembly defined by a rigid brush dowel 36 with a conventional bearing assembly (not shown) and an end cap 40 mounted to each end of the brush dowel 36. A plurality of bristle tufts 44 are arranged in a chevron pattern and protrude radially outwardly from the brush dowel 36. The end caps 40 are adapted to press fit over the bearing assemblies (not shown) of the agitator 34. Keyed protrusions (not shown) on the outer surface of the end caps 40 are received within corresponding pockets 46 formed in the brush housing insert 28. The keyed protrusions are configured to prevent rotation of the end caps 40 relative to the brush housing insert 28, thus permitting the brush dowel 36 to rotate about a fixed brush shaft (not shown) and relative to the brush housing insert 28. The brush dowel 36 further comprises a cylindrical brush pulley 48 mounted to the driven end of the brush dowel 36. The brush pulley 48 can comprise a material that is dissimilar from the brush dowel 36 material, namely a thermoplastic material offering enhanced temperature and wear resistance, such as Nylon or the like.

Referring to FIGS. 2 and 3, a sole plate 50 is adapted for mounting beneath the top cover 27 of the foot assembly 14 to retain the agitator 34 within the brush housing insert 28. The sole plate 50 comprises a rectangular framework 54 surrounding a central opening 56 that corresponds to the suction nozzle opening 30 (FIG. 1). Structural cross-members 58 span the central opening 56 to enhance structural integrity and prevent ingestion of excessively large items. A belt cover 60 extends rearwardly from one end of the sole plate 50 and is adapted to shield first and second stretch belts 62, 64. The sole plate 50 can be fastened to the brush housing insert 28 and top cover 27 via mechanical fasteners (not shown), integrally formed snaps, or a combination thereof as is commonly known in the art.

Figure 4:
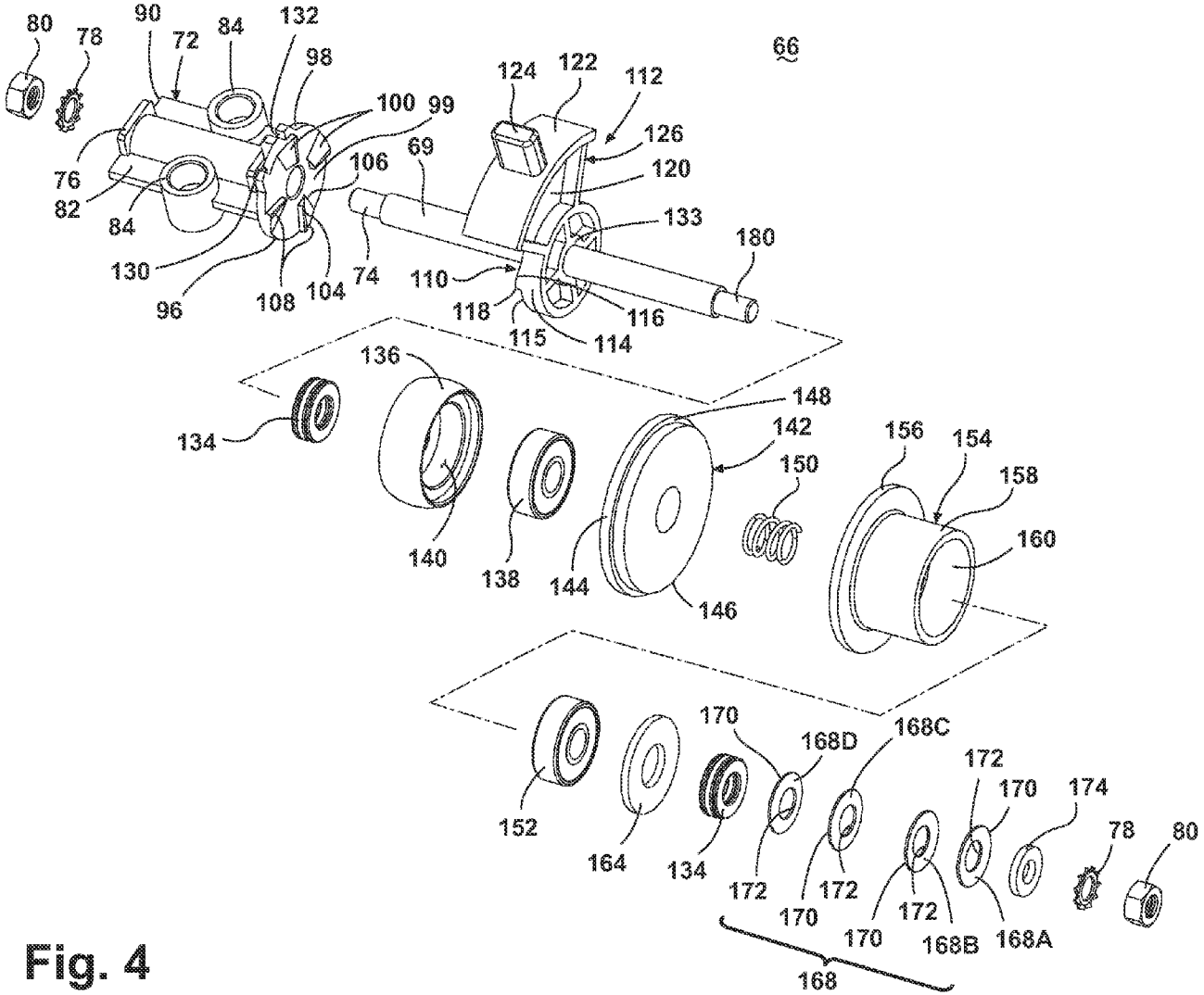
FIG. 4 is an exploded view of a clutch assembly according to a first embodiment of the invention.

A clutch module 66 is mounted to the inside surface of the top cover 27 and is positioned between the agitator 34 and the vacuum motor/fan 22. Referring additionally to FIG. 4, an exploded view of the clutch module 66 is illustrated. The first stretch belt 62 operably connects a vacuum motor/fan shaft 26 to a driven clutch pulley 136 on the clutch module 66. The second stretch belt 64 operably connects a drive pulley 158 on the clutch module 66 to the brush pulley 48. A fixed, transversely oriented clutch shaft 69 is received within a cylindrical recess 70 in a thermoplastic clutch body 72. A first threaded end 74 of the clutch shaft 69 is secured to a distal end 76 of the clutch body 72 with retainers, in the form of a conventional lock washer 78 and retention nut 80, for example. The clutch body 72 comprises a rectangular mounting platform 82 with two vertically oriented screw bosses 84 for securing the clutch module 66 to the top cover 27 via conventional threaded fasteners (not shown).

As shown in FIG. 3, the clutch module 66 is configured for facile, drop-in installation to the top cover 27 as a complete sub-assembly. The clutch module 66 is adapted to drop into a clutch mounting pocket 86 formed by mounting ribs 88 protruding from the inner surface of the top cover 27. Longitudinal sides 90 of the rectangular mounting platform 82 are received within corresponding notches 92 formed in the opposed mounting ribs 88. The screw bosses 84 of the clutch body 72 are adapted to slide onto corresponding mounting studs 94 that protrude from the inner surface of the top cover 27. The notches 92 in the mounting ribs 88 are configured to fit snugly around the longitudinal sides 90 of the mounting platform 82 to limit rotation of the clutch module 66 during use.

Referring again to FIG. 4, a circular plate 98 is oriented perpendicular to the mounting platform 82 and located at a proximal end 96 of the clutch body 72. A plurality of ramps 100 protrude outwardly from a face 99 of the circular plate 98. Each ramp 100 comprises an inclined ramp surface 104 that angles outwardly from a leading edge 106 on the face 99 of the plate 98. The ramp surface 104 terminates in a flat landing portion 108 that is spaced from the face 99 and substantially parallel thereto. The ramps 100 are adapted to slidingly mate with corresponding cam lobes 110 formed on a clutch lever cam 112.

The clutch lever cam 112 comprises a disk-shaped body 114 having a hole through its central axis that is adapted to slide freely over the clutch shaft 69. Cam lobes 110 protrude from an interior face 115 of the disk-shaped body 114. Each cam lobe 110 comprises an inclined cam surface 116 and flat landing portion 118 similar to the ramps 100 on the clutch body 72. The inclined cam surfaces 116 of the cam lobes 110 form supplementary angles with the inclined ramp surfaces 104 such that the opposed inclined surfaces 104, 116 can matingly engage in sliding fashion so as to displace the clutch lever cam 112 axially with respect to the clutch body 72. Additionally, an arcuate coplanar rib 120 protrudes outwardly from the perimeter of the disk-shaped body 114 and an arcuate shroud 122 is located at the distal end of the coplanar rib 120. A user-engageable grip 124 protrudes from the outer surface of the shroud 122, defining a lever arm 126 that extends from the disk-shaped body 114 of the clutch lever cam 112 to the grip 124 for manipulating the rotational position of the clutch lever cam 112 relative to the clutch body 72.

Upon assembling the clutch module 66 to the top cover 27, the grip 124 of the lever arm 126 protrudes through an opening 127 (FIG. 2) in the top cover 27 (FIG. 2) for selective manipulation by a user. A position limiter rib 128 (FIG. 6) protrudes from the inner face of the arcuate rib 120 and is located between the arcuate shroud 122 and the outer circumference of the disk-shaped body 114. The position limiter rib 128 is adapted to limit the rotational position of the lever arm 126 between forward and rearward stops 130, 132 that protrude outwardly from the perimeter of the circular plate 98 of the clutch body 72. Thus, the clutch lever cam 112 is rotatable between a rearward, engaged position wherein the position limiter rib 128 contacts the rear stop 132, and a forward, disengaged position wherein the position limiter rib 128 contacts the forward stop 130.

Figure 5:
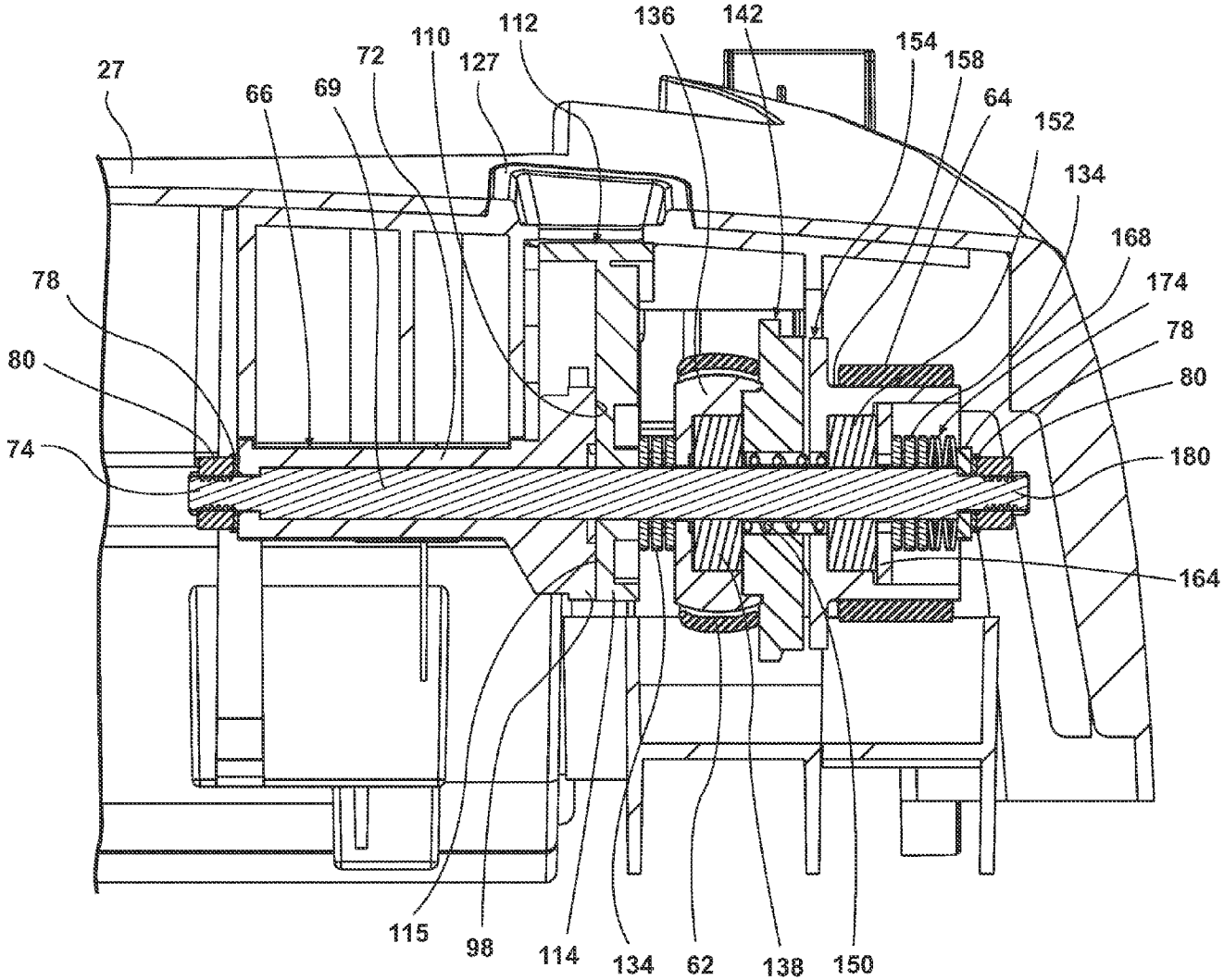
FIG. 5 is a partial section view of the foot assembly of FIG. 1, taken along line 5-5 of FIG. 1, illustrating the clutch assembly in the engaged position.
Figure 6:
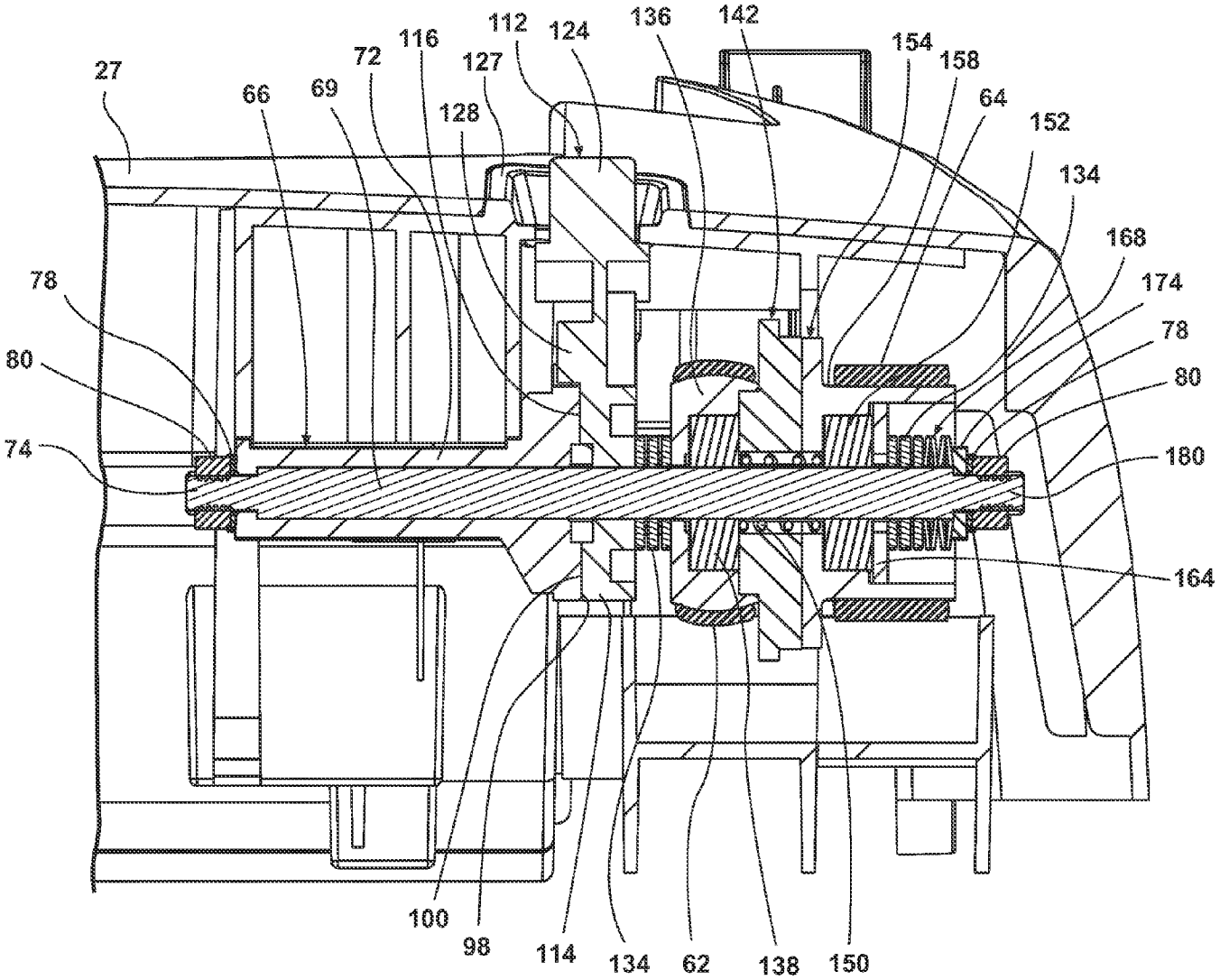
FIG. 6 is a partial section view of the foot assembly of FIG. 1, taken along line 6-6 of FIG. 1, but illustrating the clutch assembly in the disengaged position.

Now referring to FIGS. 4-6, a cross-sectional view of the clutch module 66 is illustrated, showing a hub 133 at the center of the disk-shaped body 114 of the clutch lever cam 112 positioned adjacent to a conventional thrust bearing 134.

A driven clutch pulley 136 adjacent the thrust bearing 134 rotates about the clutch shaft 69 on a pulley bearing 138 that is seated within a corresponding pocket 140 in the driven clutch pulley 136. A clutch plate 142 comprises flat disk 144 formed of a rigid thermoplastic material. Alternatively, the clutch plate 142 can be formed of metal or another suitably rigid, lightweight material. The clutch plate 142 is preferably bonded to the driven clutch pulley 136 by any suitable attachment means, such as sonic-welding, spin-welding, overmolding, or adhesive, for example. A friction pad 146 is bonded to an outer face 148 of the driven clutch plate 142. The friction pad 146 preferably comprises material with a high coefficient of friction such as cork, for example. A through-hole in the clutch plate 142 and friction pad 146 is sized to clear a compression spring 150 that is mounted over the clutch shaft 69 and positioned between the pulley bearing 138 and a clutch backing bearing 152 seated within a clutch backing 154. The compression spring 150 is sized to apply an outward axial force to the opposed bearings 138, 152 to bias the clutch pulley 136 and clutch backing 154 apart.

The clutch backing 154 comprises a backing plate 156 that is oriented parallel to and normally spaced from the friction pad 146 on the outer face 148 by at least 0.5 mm when the clutch lever cam 112 is fully disengaged. The clutch backing 154 further comprises a drive pulley 158 with a stepped inner wall 160 sized to receive the clutch backing bearing 152, a spacer washer 164, a thrust bearing 134 and a plurality of Belleville washers 168. Four Belleville washers 168*a-d* are oriented to occupy a maximum length along the clutch shaft 69 as follows: outer diameters 170 of the first 168*a* and second 168*b* washers are in contact and inner diameters 172 of the first 168*a* and second 168*b* washers are spaced apart; the inner diameters 172 of the second 168*b* and third 168*c* washers are in contact and the outer diameters 170 of the second 168*b* and third 168*c* washers are spaced apart; and the outer diameters 170 of the third 168*c* and fourth 168*d* washers are in contact. This configuration forms an "M" shaped cross-section as shown in FIG. 5. The clutch backing 154 and associated aforementioned components are retained to a stepped second threaded end 180 of the clutch shaft 69 via a flat washer 174 and a lock washer 78. A retention nut 80 is threaded onto the second threaded end 180 of the clutch shaft 69.

In operation, a user prepares the vacuum cleaner 10 for use by connecting the device to a line power source and actuating the power switch (not shown) to energize the vacuum motor/fan assembly 22. As the vacuum motor/fan shaft 26 rotates, it drives the first belt 62, which, in turn, rotates the driven clutch pulley 136. When the clutch lever cam 112 is in its forward, disengaged position such that the position limiter rib 128 contacts the forward stop 130 and the ramps 100 on the clutch body 72 are not engaged with the cam lobes 110 on the disk-shaped body 114 of the clutch lever cam 112, the compression spring 150 applies an outward axial force against the pulley bearing 138 seated within the driven clutch pulley 136 and the opposed clutch backing bearing 152 seated within the clutch backing 154. The compression spring 150 thus forces the driven clutch plate 142 away from the clutch backing 154 and prevents transmission of rotational energy from the driven clutch pulley 136 to the clutch backing 154. In this disengaged state, the agitator 34 remains stationary within the brush housing insert 28 despite the operation of the vacuum motor/fan assembly 22 and rotation of the driven clutch pulley 136. Thus, a user may selectively disengage the agitator 34 for various cleaning conditions, such as when delicate surfaces are encountered or above floor cleaning with the upholstery hose, for example.

To commence rotation of the agitator 34, a user pushes the grip 124 of the lever arm 126, which protrudes through the opening 127 in the top cover 27, rearwardly to rotate the clutch lever cam 112 to its rearward, engaged position. As the clutch lever cam 112 rotates rearwardly to its engaged position where the position limiter rib 128 contacts the rear stop 132, the inclined cam surfaces 116 of the cam lobes 110 slide along the inclined ramp surfaces 104 of the circular plate 98, pushing the face 115 of the clutch lever cam 112 away from the clutch body 72 until the flat landing portions 108, 118 of the ramps 100 and cam lobes 110 come into engagement. In this engaged state, the disk-shaped body 114 of the clutch lever cam 112 is displaced approximately 1.5 mm from the clutch body 72, along the clutch shaft 69 axis. The displacement of the clutch lever cam 112 along the clutch shaft 69 axis forces the driven clutch pulley 136 toward the clutch backing 154, thereby compressing the compression spring 150 that normally forces the two components apart. Displacement of the clutch lever cam 154 also compresses the Belleville washers 168 mounted between the retention nut 80 on the second threaded end 180 of the clutch shaft 69 and the thrust bearing 134 adjacent to the spacer washer 164 and the clutch backing bearing 152.

When the clutch lever cam 112 reaches its engaged position, the friction pad 146 on the clutch plate 142 contacts and grips the backing plate 156 of the clutch backing 154, thereby transmitting rotation from the vacuum motor/fan shaft 26 through the driven clutch pulley 136 to the clutch backing 154 and associated drive pulley 158. Thrust bearings 134 and Belleville washers 168 mounted along the clutch shaft 69 as previously described effectively prevent binding and ensure proper transmission of axial forces to the respective rotatably mounted components. The drive pulley 158 is operably connected to the brush pulley 48 on the agitator 34 via a second stretch belt 64. Accordingly, the rotating drive pulley 158 drives the agitator 34 when the clutch lever cam 112 is rotated rearwardly to its engaged position.

Because the components of the clutch module 66 are retained along the clutch shaft 69 between first and second threaded ends 74, 180 by lock washers 78 and retention nuts 80, the axial forces generated by displacement of the clutch lever cam 112 and subsequent compression of Belleville washers 168 are isolated from the remaining components in the foot assembly 14, including the top cover 27. This configuration prevents wear, stress, strain, and potential breakage of the components within the foot assembly 14 to which the clutch module 66 is mounted. The axial forces generated by the displacement of the internal clutch components, including the Belleville washers 168 and compression spring 150, can be relatively high, therefore isolating these forces along the shaft of the clutch module 66 advantageously protects the remaining components in the foot assembly 14.

Figure 7:
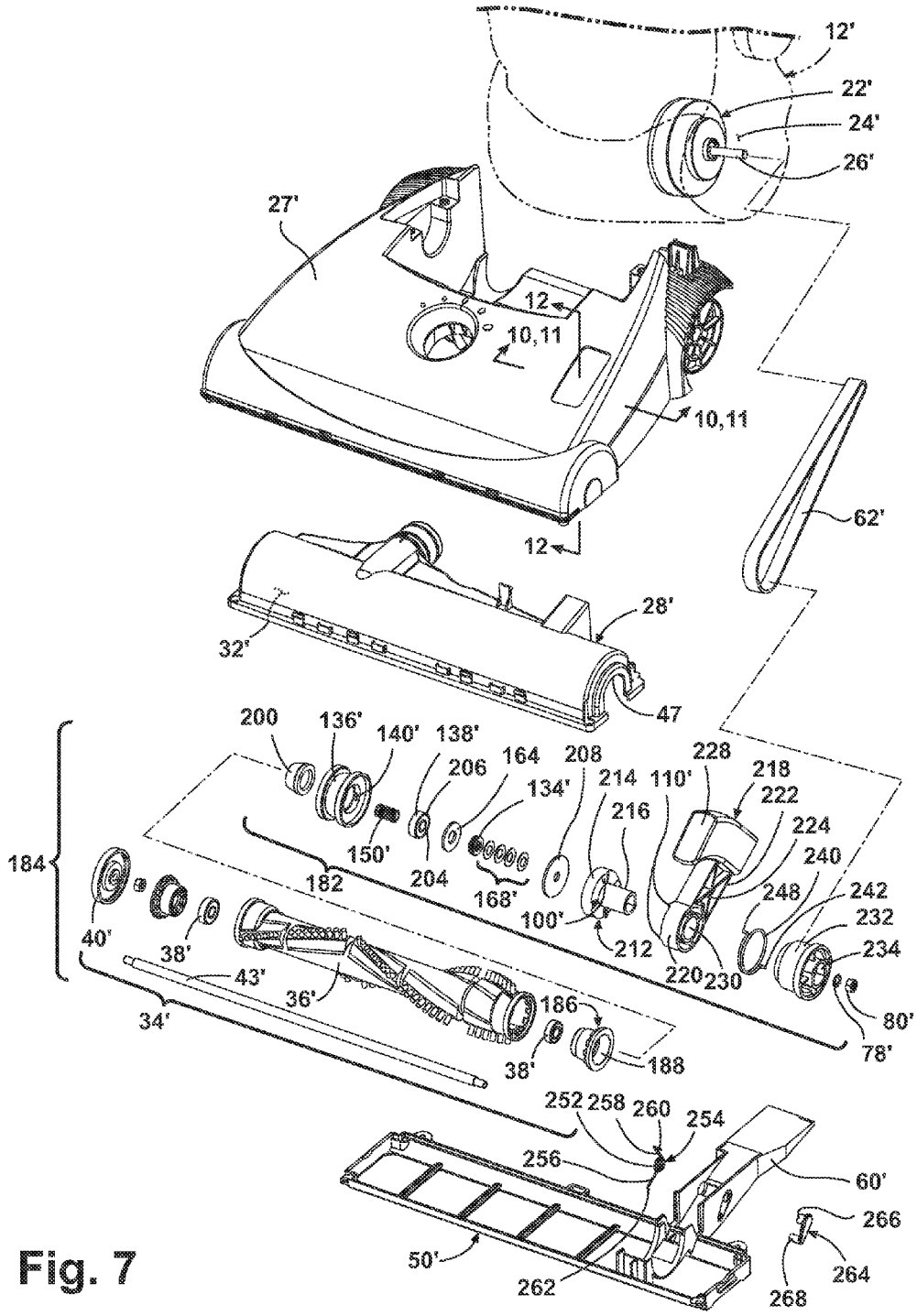
FIG. 7 is a partial exploded view of a foot assembly and a clutch assembly according to a second embodiment of the invention.

FIG. 7 is a partial exploded view of a foot assembly according to a second embodiment of the invention, where like features are indicated with the same reference numeral bearing a prime (') symbol. The second embodiment of the clutch module can be employed with the vacuum cleaner 10 of FIG. 1 in place of the first embodiment of the invention. In the second embodiment, an in-line clutch module 182 is axially mounted to the agitator 34' along the brush shaft 43' to form an agitator assembly 184 that can be selectively engaged via a user-engageable clutch pedal 218. The entire agitator assembly 184 is configured for simple drop-in, modular assembly into the brush mounting recess 32'.

Figure 8:
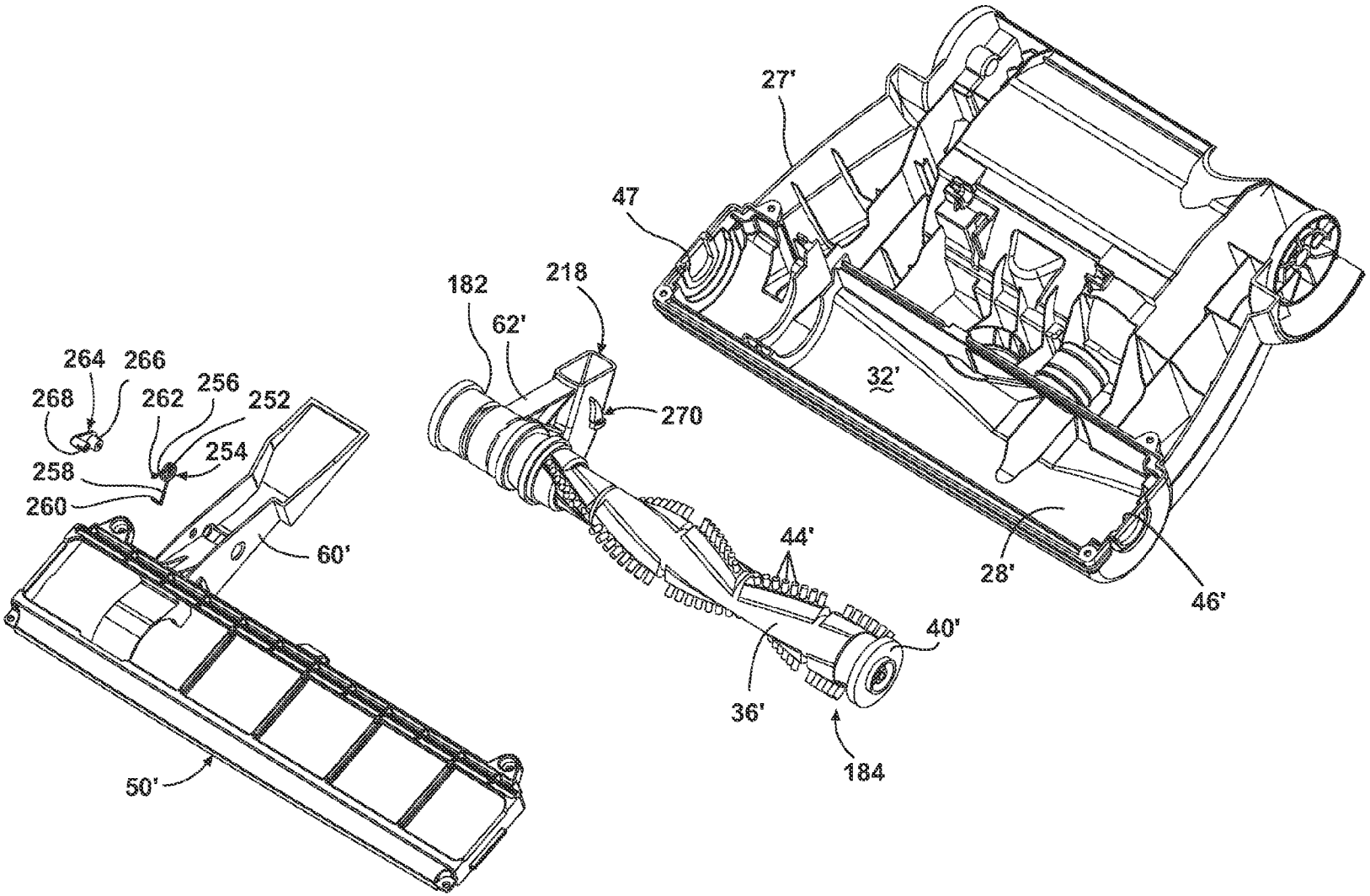
FIG. 8 is a bottom, partial exploded view showing the underside of the foot assembly of FIG. 7.
Figure 9:
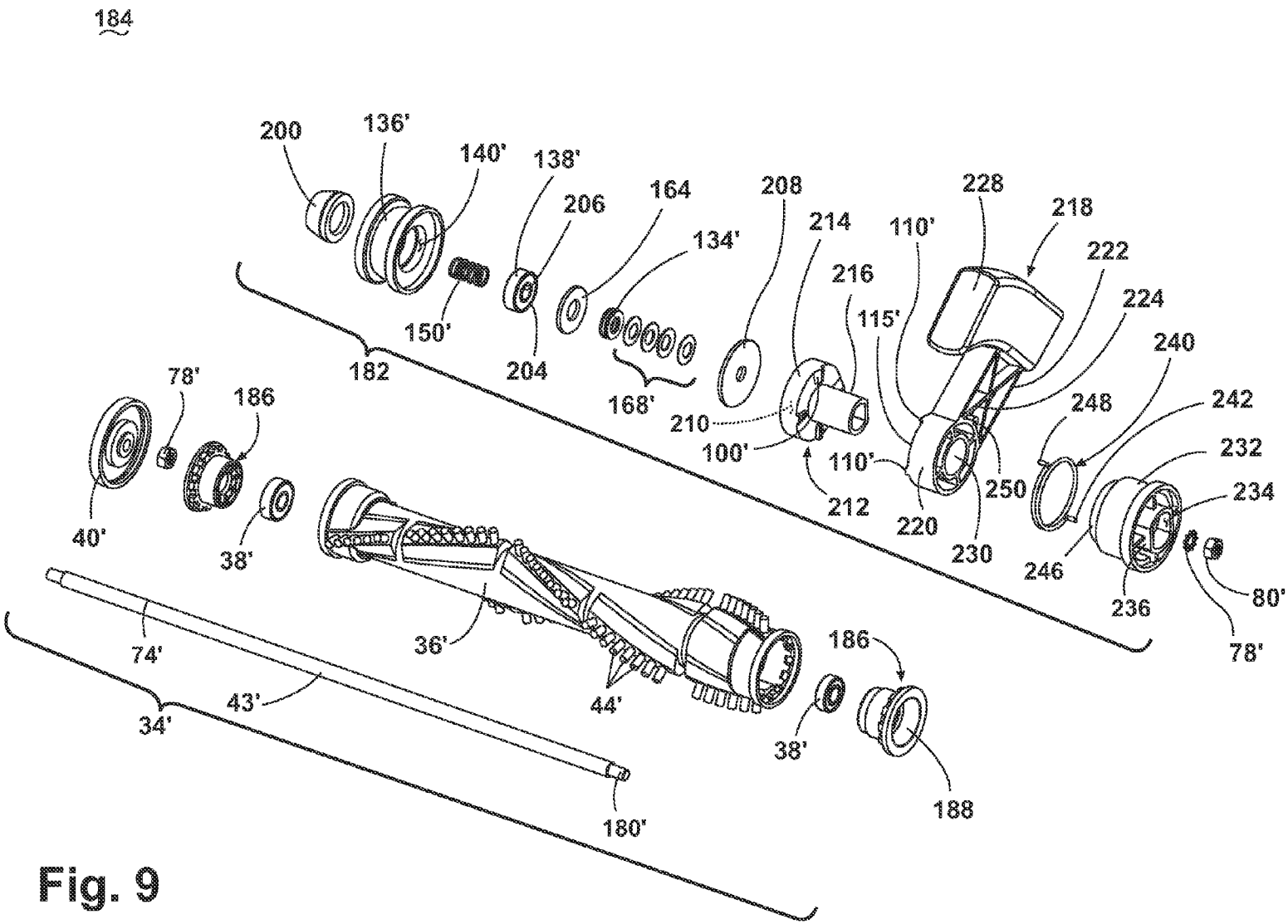
FIG. 9 is an exploded view of an agitator and the clutch assembly of FIG. 7.

As shown in FIGS. 7-9, the agitator assembly 184 comprises a brush dowel 36' with a plurality of bristle tufts 44'. Brush bearings 38' are mounted within corresponding pockets in the distal and proximal ends of the brush dowel 36'. The brush bearings 38' are fixed to an elongate, transversely oriented brush shaft 43'. The proximal end of the dowel 36' comprises a clutch receiver 186 having an inward conical contact surface 188. The distal end of the dowel 36' receives an end cap 40', which is press-fit around the brush bearing 38'. The end cap 40' is received in an end cap mounting pocket 46' within the brush housing insert 28'. The end cap mounting pocket 46' further comprises a keyed feature (not shown) that prevents rotation of the end cap 40' in the brush housing insert 28'. The in-line clutch module 182 comprises a driven clutch pulley 136' with a conical clutch face 190 (FIG. 10) that protrudes outwardly from the interior face of the pulley 136'. The conical clutch face 190 is adapted to receive a conically shaped friction pad 200, made of material with a high coefficient of friction such as cork, for example. Additionally, a pulley bearing 138' is mounted within a pocket 140' in the exterior face of the pulley 136'.

Figure 10:
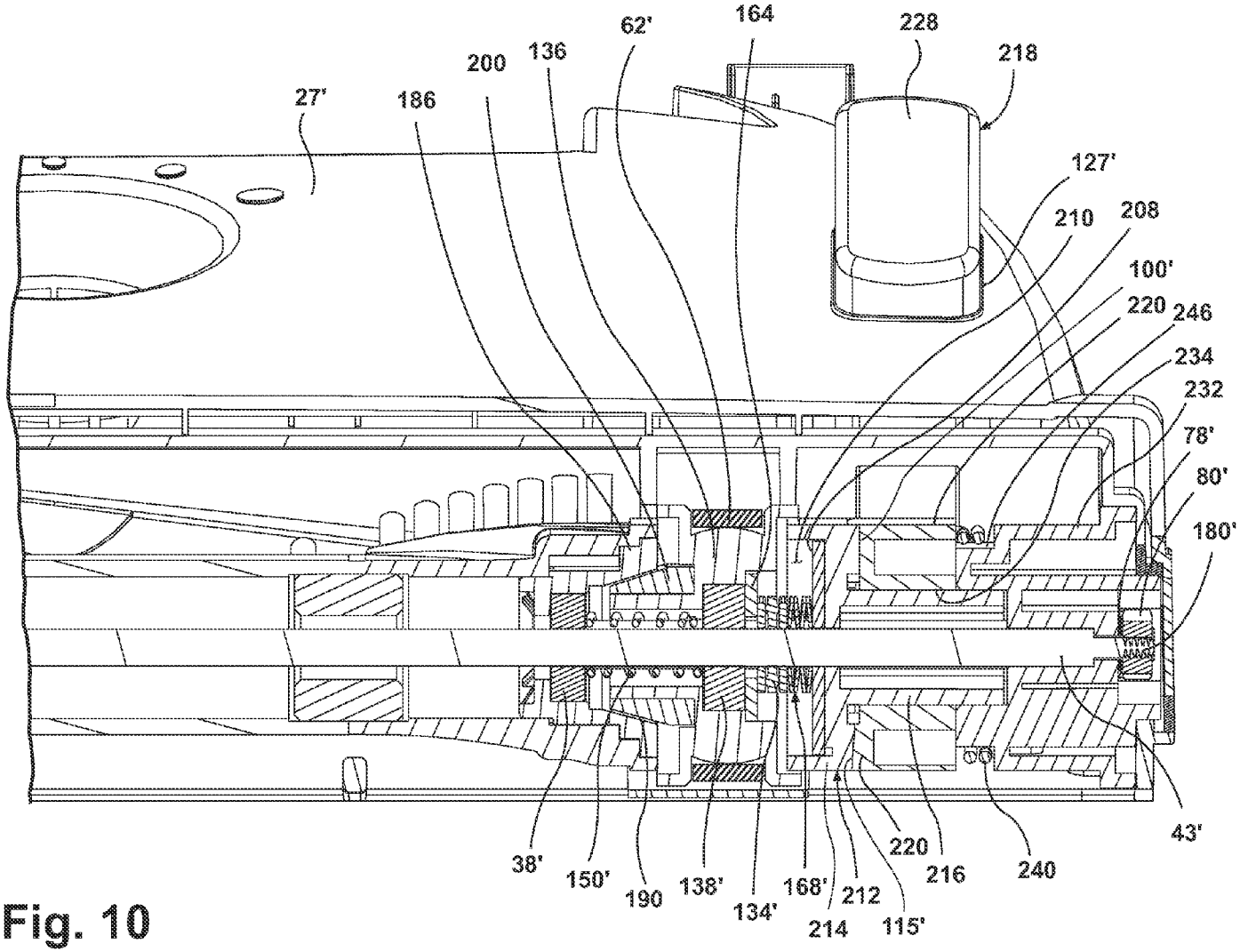
FIG. 10 is a partial section view of the foot assembly of FIG. 7, taken along line 10-10 of FIG. 7, illustrating the clutch assembly in the disengaged position.

FIG. 10 shows a partial section view of the agitator assembly 184 with the in-line clutch module 182 in the disengaged position. A compression spring 150' is mounted on the brush shaft 43' between the proximal brush bearing 38' and the pulley bearing 138' to force the clutch pulley 136' away from the clutch receiver 186 that is mounted within the proximal end of the brush dowel 36'. The pulley bearing 138' is operably connected to the vacuum motor/fan shaft 26' (FIG. 7) via a stretch belt 62' so that the pulley bearing 138' rotates continuously whenever the vacuum motor/fan 22' is energized. A first spacer washer 164 is slidably mounted along the brush shaft 43' and is sized such that the interior washer face contacts a stationary outer race 204 of the clutch pulley bearing 138' while clearing an inner race 206 of the clutch pulley bearing 138'. The exterior face of the first spacer washer 164 contacts a thrust bearing 134' that is mounted axially on the brush shaft 43' adjacent to a plurality of Belleville washers 168' that are constrained by a second spacer washer 208. The second spacer washer 208 is received within a cylindrical recess 210 of a clutch driver 212. The clutch driver 212 is slidably mounted to the brush shaft 43' and comprises a driver body 214. A D-shaped sleeve 216 protrudes axially outwardly from the exterior face of the driver body 214. The exterior face of the clutch driver 212 further comprises a plurality of ramps 100' substantially similar to those previously described with respect to the clutch body 72 of the first embodiment of the invention.

Figure 11:
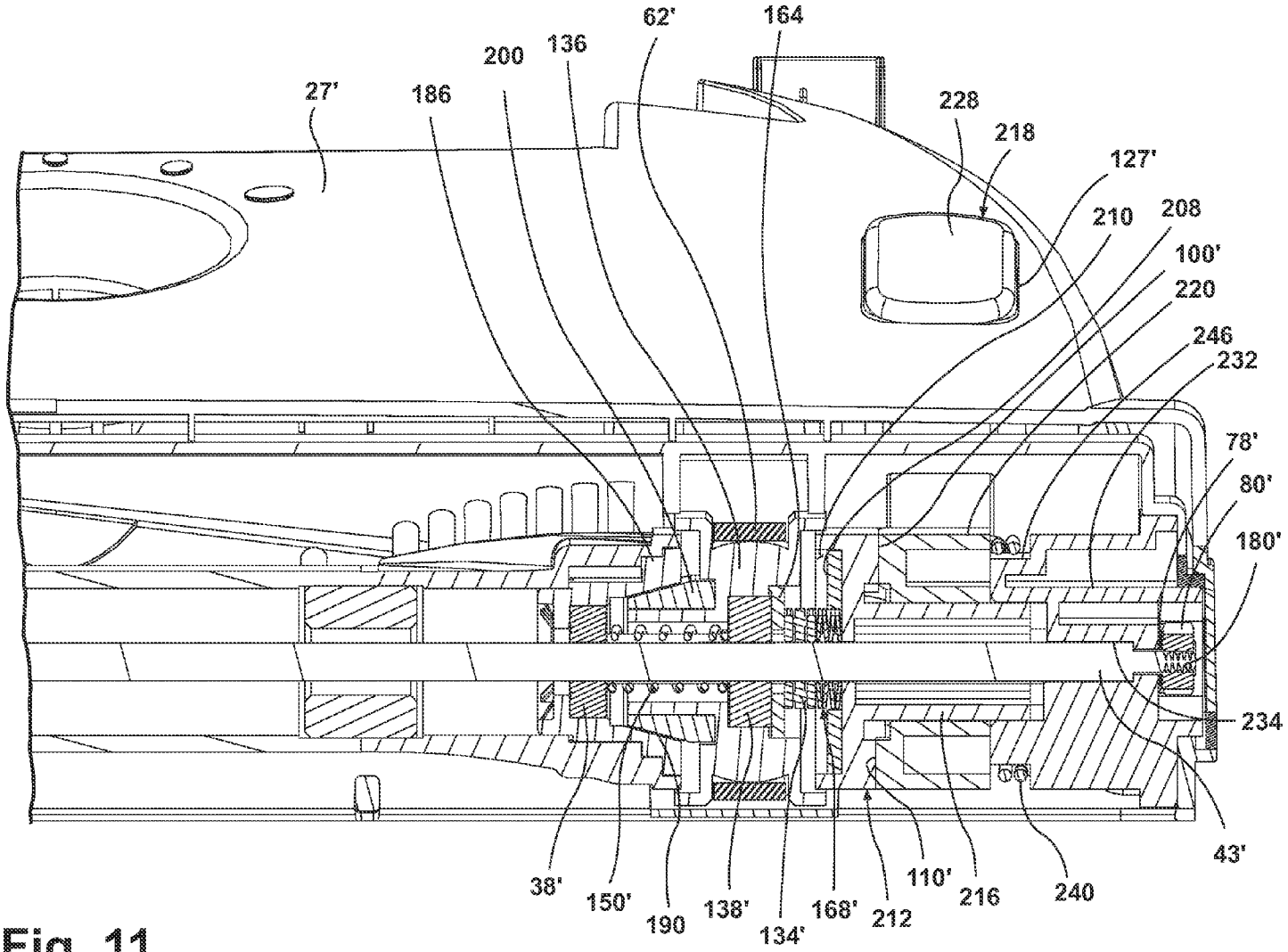
FIG. 11 is a partial section view of the foot assembly of FIG. 7, like FIG. 10 taken along line 11-11 of FIG. 7, illustrating the clutch assembly in the engaged position.

Referring now to FIGS. 9-11, a clutch pedal 218 comprises a cylindrical cam body 220 from which a pedal arm 222 extends radially outward. The pedal arm 222 comprises a substantially I-beam cross-sectional structure with additional cross-braces 224. A foot pedal 228 is positioned at the distal end of the pedal arm 222 and is configured to protrude through a corresponding opening 127' in the top cover 27' for engagement by a user.

The pedal cam body 220 comprises a plurality of cam lobes 110' protruding from the interior face thereof, which are substantially similar to those previously described with respect to the clutch lever cam 112 of the first embodiment of the invention. An inner diameter 230 of the cam body 220 slidably rotates about the D-shaped sleeve 216 of the clutch driver 212.

A clutch base 232 is axially mounted to the brush shaft 43' adjacent to the clutch pedal 218. The clutch base 232 is secured to the second threaded end 180' of the brush shaft 43' by a lock washer 78' and retention nut 80'. The clutch base 232 comprises an axially positioned D-shaped channel 234 formed therethrough for receiving the D-shaped sleeve 216 of the clutch driver 212 therein. The exterior face of the clutch base 232 comprises a keyed protrusion 236 that is adapted to mate with a keyed pocket 47 (FIG. 8) in the brush mounting recess 32' (FIG. 8). Accordingly, the keyed protrusion 236 prevents rotation of the clutch base 232 about the brush shaft 43'. In turn, the D-shaped channel 234 of the clutch base 232 engages the D-shaped sleeve 216 of the clutch driver 212, thereby preventing its rotation about the brush shaft 43' as well.

A pedal return torsion spring 240 comprises a fixed end 242 and a free end 248. The fixed end 242 is secured to a mounting hole 244 formed on a stepped inboard face 246 of the clutch base 232, and the free end 248 is press fit within a corresponding mounting hole 250 on the pedal arm 222. The torsion spring 240 is biased to normally force the clutch pedal 218 into its extended, unengaged position shown in FIG. 10, wherein the cam lobes 110' of the cam body 220 are not engaged with the ramps 100' of the clutch driver 212.

Figure 12:
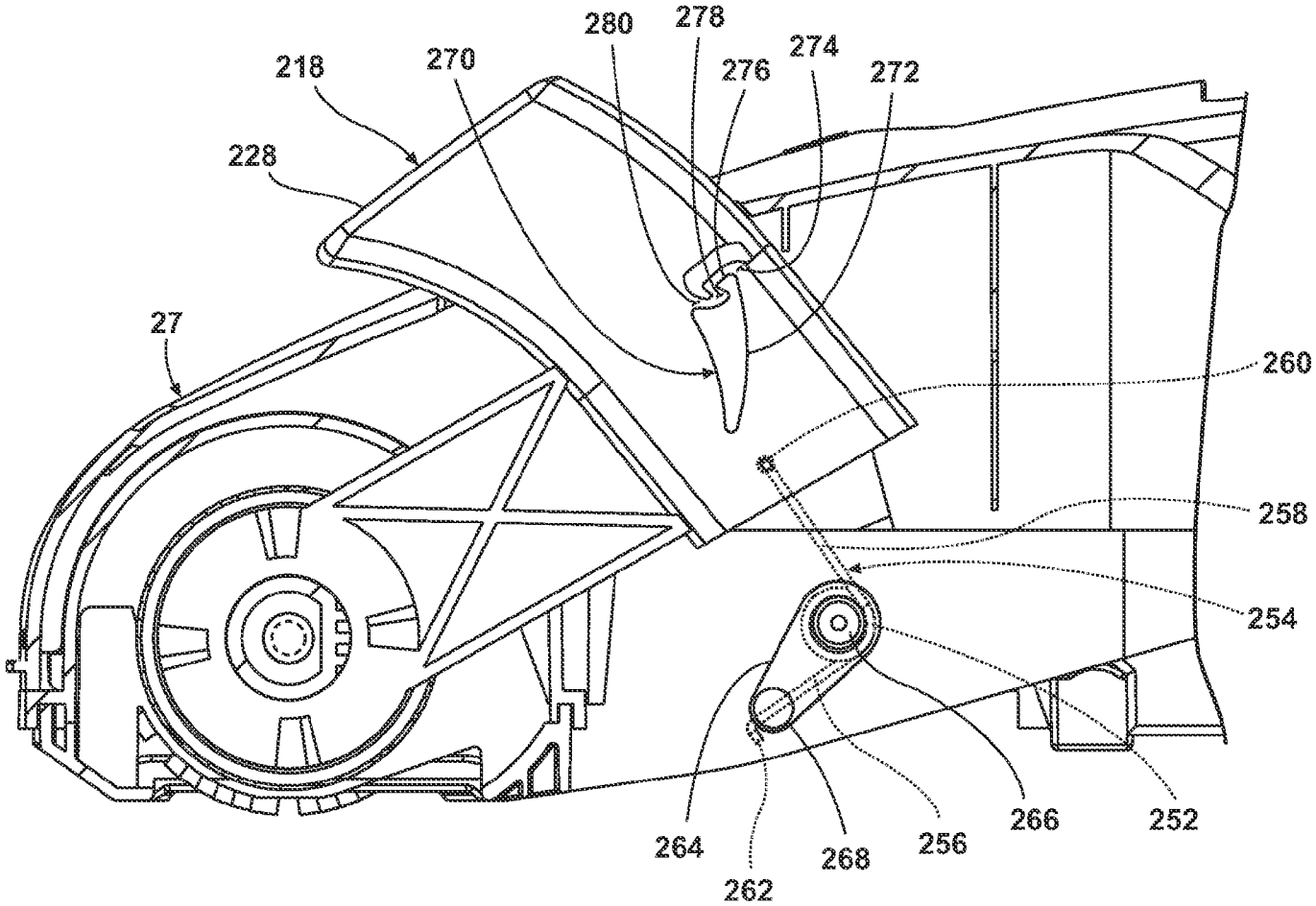
FIG. 12 is a schematic view of a resettable detent for a clutch pedal of the in-line clutch module of FIGS. 7-11 with the clutch module in the disengaged position.
Figure 13:
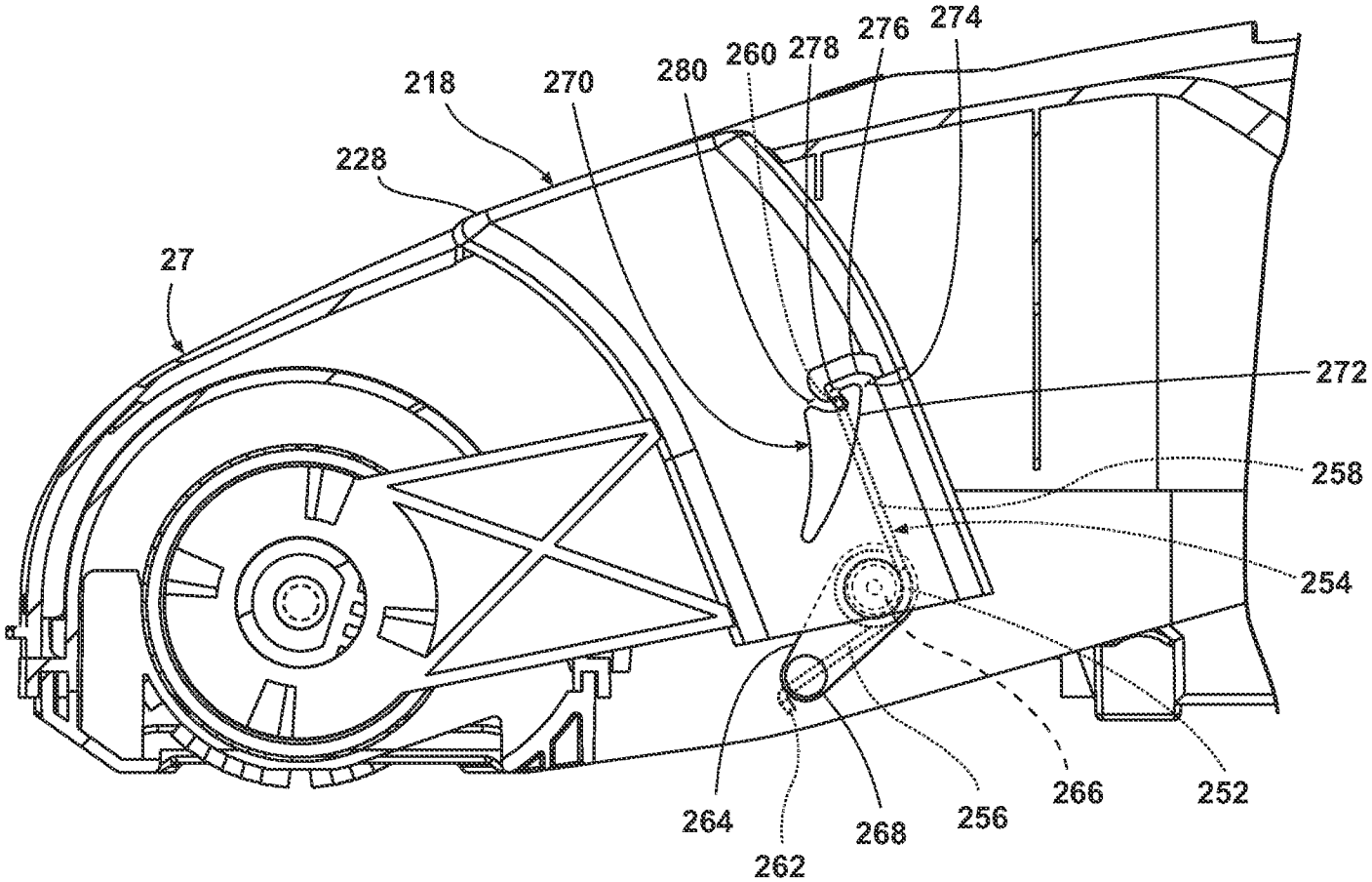
FIG. 13 is a schematic view of the resettable detent mechanism of FIG. 12 with the clutch pedal of the foot assembly of FIGS. 7-11 in the engaged position.

As shown in FIGS. 12-13, the clutch pedal 218 further comprises a push-push detent mechanism. The push-push detent mechanism comprises a resettable detent mechanism 252 configured to retain the clutch pedal 218 in a downward, engaged position after a user initially depresses the foot pedal 228. The detent mechanism 252 is resettable such that when a user depresses the engaged foot pedal 228, the pedal 228 is released and forced upwardly to its unengaged position by the pedal return torsion spring 240 (FIG. 9). The detent mechanism 252 comprises a second torsion spring 254 with V-shaped legs comprising a fixed leg 256 and a movable latching leg 258 formed with an acute angle therebetween. A bent latch segment 260 on the free end of latching leg 258 is parallel to the second torsion spring 254 bending axis, and the fixed leg 256 comprises a bent retention segment 262 orthogonal to the second torsion spring 254 bending axis. A mounting bracket 264 is affixed to a sidewall of the belt cover 60' and comprises a first, transversely oriented, mounting post 266 that slidably receives the second torsion spring 254 thereon. The mounting bracket 264 further comprises a second, transversely oriented, slotted post 268 that receives the fixed leg 256 of the second torsion spring 254; the retention segment 262 retains the fixed leg 256 thereto. The latch segment 260 selectively engages an arcuate cam guide 270 that is located on the interior sidewall of the foot pedal 228 when the foot pedal 228 is depressed and released. The cam guide 270 comprises an engagement track 272 that is configured to move relative to the latch segment 260 and eventually guide the latch segment 260 into a catch opening 274, whereupon the latch segment 260 engages and retains a catch hook 276. The catch hook 276 retains the pedal 228 in its downward, engaged position.

To release the detent mechanism 252, the user can depress the clutch pedal 218 slightly, releasing the catch hook 276 from the latch segment 260. In turn, a release track 278 engages the latch segment 260 and causes the latching leg 258 to deflect slightly, eventually guiding the latch segment 260 to a catch exit 280. When the latch segment 260 is released from the catch exit 280, the clutch pedal 218 is released and forced upward by the pedal return torsion spring 240 (FIG. 9). Accordingly, the release track 278 moves relative to the latch segment 260 and the foot pedal 228 returns to its upright, unengaged position, thus resetting the pedal detent mechanism 252.

In operation, a user prepares the vacuum cleaner 10' for use as previously described. Upon energizing the cleaner 10', the vacuum motor/fan shaft 26' drives the stretch belt 62' that is operably connected to the clutch pulley 136'. When the clutch pedal 218 is in its upright, unengaged position such that the cam lobes 110' of the cam body 220 are not engaged with the ramps 100' of the clutch driver 212, the axially mounted compression spring 150' forces the clutch pulley 136' away from the corresponding clutch receiver 186 mounted to the end of the brush dowel 36'. Accordingly, the brush dowel 36' remains stationary while the clutch pulley 136' is rotatably driven by the vacuum motor/fan shaft 26' via the stretch belt 62'.

To engage the brush dowel 36', a user engages the in-line clutch module 182 by depressing the clutch pedal 218 downward into the opening 127' in the top cover 27'. The rearward movement of the pedal arm 222 compresses the pedal return torsion spring 240 mounted to the clutch base 232 and pedal arm 222. The pedal cam body 220 rotates about the fixed D-shaped sleeve 216 of the clutch driver 212, which is retained in the D-shaped channel 234 of the clutch base 232. As the cam body 220 rotates rearward, the cam lobes 110' on its interior face engage the ramps 100' on the clutch driver 212 and force the clutch driver 212 to slide axially inward along the brush shaft 43'. As the clutch driver 212 is displaced inward along the brush shaft 43', it pushes the second spacer washer 208 into the Belleville washers 168' and adjacent thrust bearing 134', which transmits the axial compression force to the first spacer washer 164. The first spacer washer 164, in turn, contacts the outer race 204 of the pulley bearing 138' mounted within the clutch pulley 136', thus displacing the clutch pulley 136' inward until the associated conical clutch face 190 is seated within the corresponding clutch receiver 186. When the conical clutch face 190 is fully engaged, the conical friction pad 200 on the conical clutch face 190 grips the clutch receiver 186 and transmits rotational energy from the vacuum motor/fan shaft 26' and clutch pulley 136' to the brush dowel 36', thus rotating the dowel 36' and permitting it to be selectively engaged. A cross-sectional view depicting the clutch module 182 in the engaged position is shown in FIG. 11.

Because the components of the in-line clutch module 182 are retained along the brush shaft 43' between first and second threaded ends 74', 180' by lock washers 78' and retention nuts 80', the axial forces generated by displacement of the clutch driver 212 and subsequent compression of Belleville washers 168' are isolated from the remaining components in the foot assembly 14, including the top cover 27.

As the clutch pedal 218 is depressed, the pedal detent mechanism 252 operates as follows: The arcuate cam guide 270 on the foot pedal 218 engages the latching leg 258 of the second torsion spring 254. The engagement track 272 guides the latch segment 260 into a catch opening 274, whereupon the latch segment 260 of the second torsion spring 254 engages and retains the catch hook 276 of the clutch pedal 218, thus retaining the pedal 218 in its downward, engaged position.

To disengage the brush dowel 36' and stop its rotation, a user depresses the clutch pedal 218 downwardly, whereupon the release track 278 engages the latch segment 260 and deflects the latching leg 258 of the second torsion spring 254 slightly. The release track 278 guides the latch segment 260 of the second torsion spring 254 to the catch exit 280. When the latch segment 260 is released from the catch exit 280, the clutch pedal 218 is forced upwardly by the pedal return torsion spring 240. Accordingly, the release track 278 slides relative to the latch segment 260 and the pedal 218 returns to its upright, unengaged position, thus resetting the pedal detent mechanism.

Figure 14:
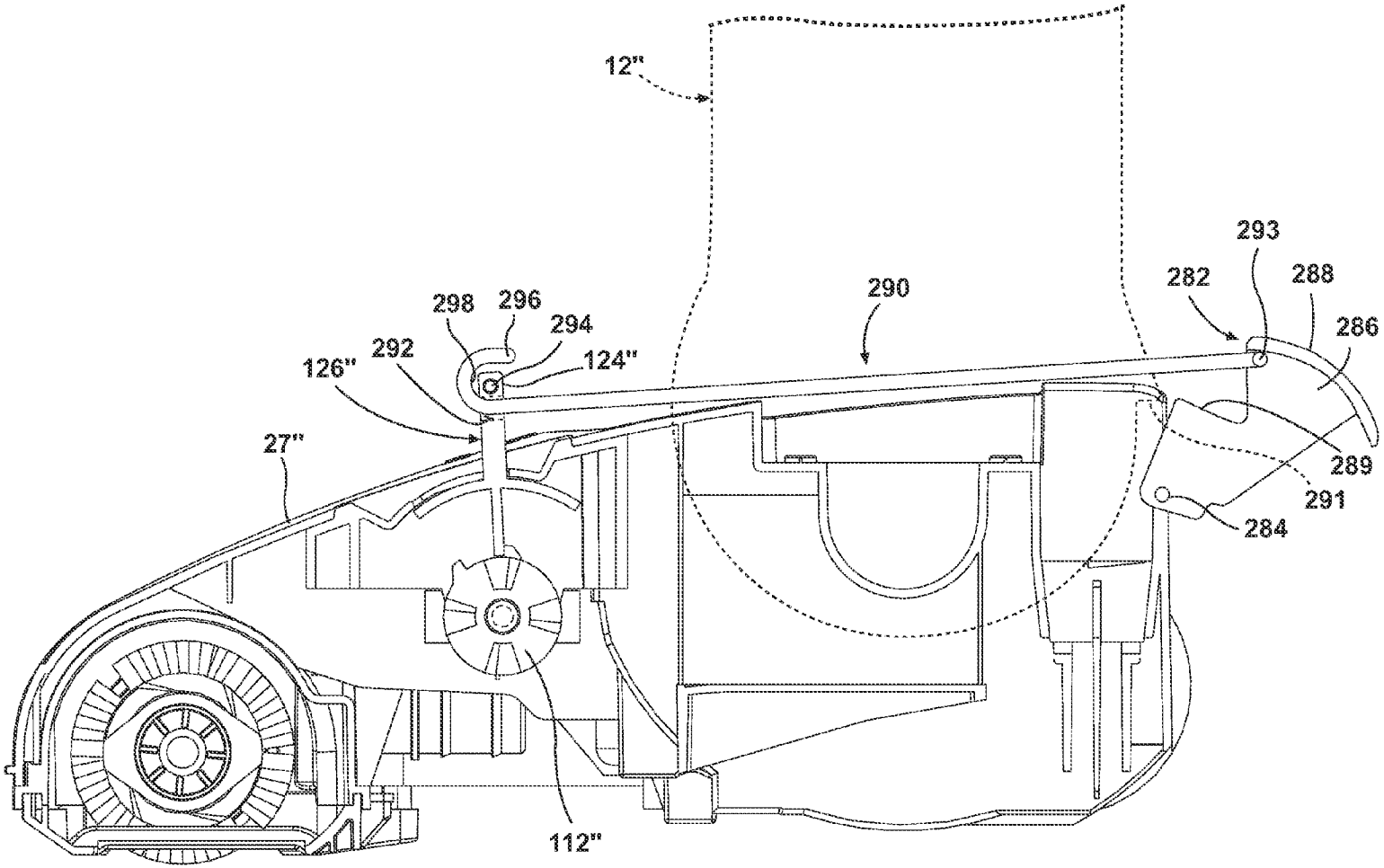
FIG. 14 is a schematic view of a handle detent pedal and linkage according to a third embodiment of the invention, illustrating an engaged position of the linkage.
Figure 15:
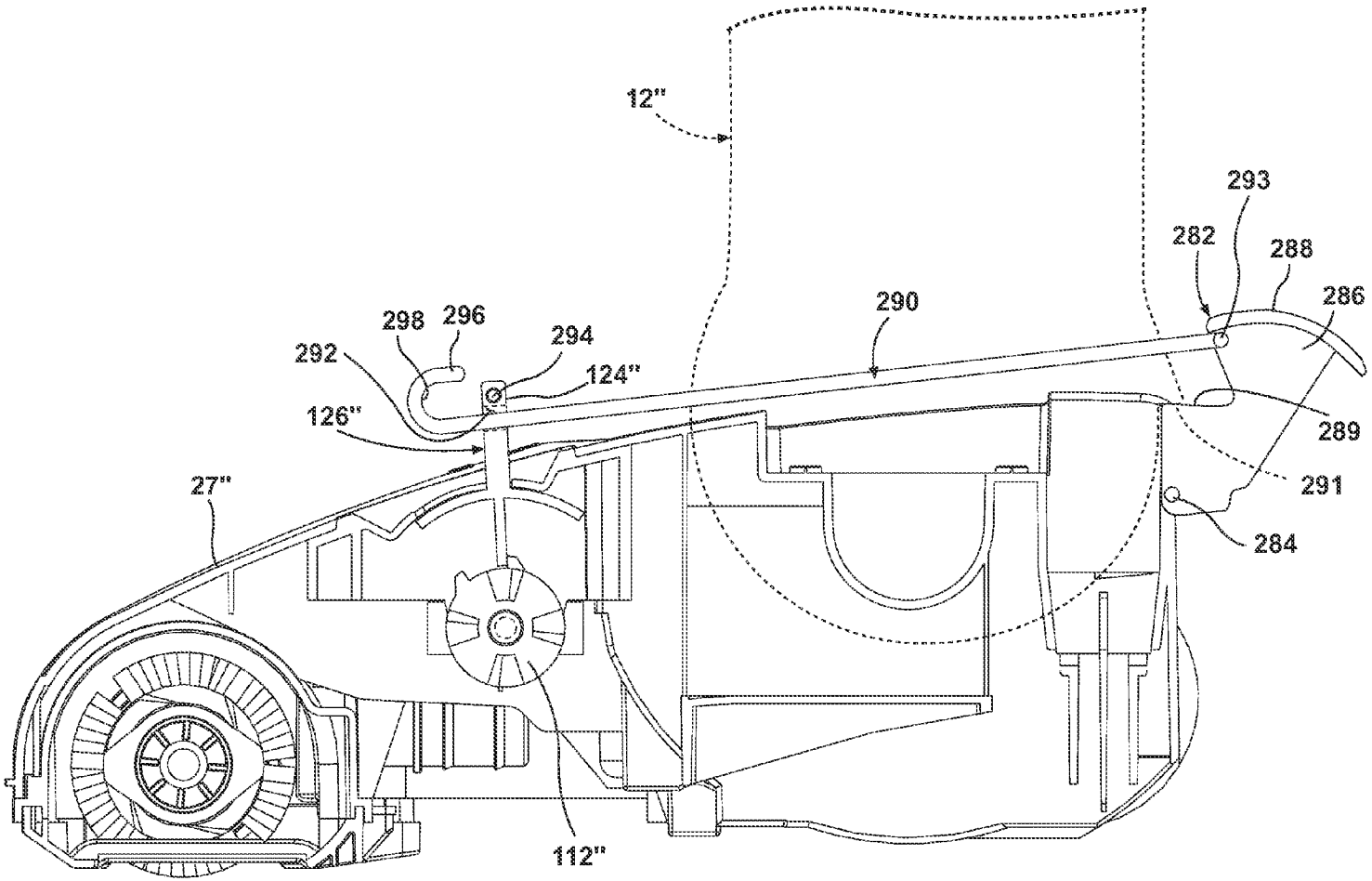
FIG. 15 is a schematic view of the handle detent pedal and linkage of FIG. 14 illustrating a disengaged position of the linkage.

FIGS. 14 and 15 are schematic views of a handle release mechanism that is illustrated with the clutch mechanism of the first embodiment of the invention where like features are indicated with the same reference numeral bearing a double prime (") symbol. A handle detent pedal 282 is pivotally mounted to the top cover 27" for selectively releasing the upright handle assembly 12" from its upright storage position to a reclined, usage position, as is commonly known in the art and illustrated in U.S. Pat. No. 6,006,401, which is incorporated herein by reference. The detent pedal 282 comprises a pivot 284, a detent pedal arm 286, a foot pad 288, and a stop 289 that is configured to engage a corresponding protrusion 291 on a lower portion of the handle assembly 12". (See for example, U.S. Pat. No. 6,006,401). Optionally, the detent pedal 282 can be spring biased so it automatically returns to its upright position after actuation by a user. A linkage 290 is pinned to the detent pedal arm 286 at a link 293 and extends to the clutch lever arm 126". The grip 124" on the end of the lever arm 126" can further comprise a slot 292 with a transversely oriented pin 294 spanning the slot 292 opening. A hook 296 on the distal end of the linkage 290 is adapted to slide through the slot 292 and surround the pin 294. An inner surface 298 of the hook 296 is configured to contact the pin 294 when the detent pedal 282 is pivoted backward.

In operation, a user energizes the vacuum cleaner 10" as previously described. Next, a user depresses the detent pedal 282, which pivots the detent pedal arm 286 rearwardly. Because the detent pedal arm 286 is pinned to the linkage 290, the linkage 290 also slides rearward together with the detent pedal 282. As the linkage 290 slides rearward, the inner surface 298 of the hook 296 contacts the pin 294 spanning the slot 292 in the grip 124" portion of the clutch lever arm 126", thereby rotating the lever arm 126" rearward, ultimately to the position shown in FIG. 14, thus engaging the clutch lever cam 112". When the user releases the detent pedal 282, the detent pedal 282 springs back to its upright, rest position, and in doing so, pushes the linkage 290 forward. The linkage 290 slides within the slot 292 and the inner surface 298 of the hook 296 slides away from the pin 294 in the grip 124" to the position shown in FIG. 15. However, the clutch lever arm 126" remains in its engaged position until manually disengaged by a user. This configuration provides a simple mechanism that automatically engages the clutch module 66" when the detent pedal 282 is actuated to recline the upright handle 12" into its use position.

While the invention has been specifically described in connection with certain specific embodiments thereof, it is to be understood that this is by way of illustration and not of limitation, and the scope of the appended claims should be construed as broadly as the prior art will permit. Reasonable variation and modification is possible within the scope of the foregoing description of the invention without departing from the spirit of the invention which is defined in the appended claims.

What is claimed is:

1. A vacuum cleaner comprising a base assembly having a housing, a suction nozzle, and an agitator rotatably mounted to the housing;

a motor; and a clutch assembly in driven relationship to the motor and in a driving relationship to the agitator for rotatably driving the agitator;

the clutch assembly comprising:

a clutch body;

a clutch plate having a friction pad and rotatably mounted to the clutch body;

a backing plate juxtaposed to the clutch plate in facing relationship thereto and rotatably mounted through the clutch body;

wherein the clutch plate and the backing plate are axially movable with respect to one another between a first position wherein the clutch plate and backing plate are frictionally joined to one another, and a second position wherein the clutch plate and backing plate are separated from one another, a spring mechanism configured to bias the clutch plate and the backing plate to the second position;

a clutch actuation mechanism aligned with the clutch plate and the backing plate to selectively move the clutch plate and the backing plate into the first position;

wherein the clutch assembly further comprises:

a shaft which is rotatably mounted to the clutch body;

the clutch body, the backing plate, the spring mechanism, and the clutch actuation mechanism are mounted on the shaft; and retainers mounted on both ends of the shaft;

wherein axial forces generated by compression of the spring mechanism when the clutch plate and backing plate are moved between the first and second positions are contained within the clutch assembly by the retainers, and the axial forces are isolated from the housing; and wherein the clutch actuation mechanism includes complementary ramped surfaces which are rotationally related to one another to push the clutch plate and the backing plate into the first position in one relative rotational position of the ramps, and to move the clutch plate and the backing plate into the second position in another relative rotational position of the ramps.

2. The vacuum cleaner according to claim 1 wherein the clutch assembly is configured as a unitary module and is mounted to the housing as a unit.

3. The vacuum cleaner according to claim 1 wherein the clutch actuation mechanism comprises a lever arm positioned for manual actuation by a user for moving the clutch actuation mechanism between the two relative rotational positions.

4. The vacuum cleaner according to claim 3 and further comprising a resettable detent mechanism between the lever arm and the housing and configured to retain the lever arm in a rotational position corresponding to the first position of the clutch plate and backing plate.

5. The vacuum cleaner according to claim 1 wherein the complimentary ramped surfaces are positioned on juxtaposed faces of a lever cam and the clutch body.

6. The vacuum cleaner according to claim 1 wherein the clutch plate and the backing plate are conically shaped.

7. A vacuum cleaner comprising a base assembly having a housing, a suction nozzle, and an agitator rotatably mounted to the housing;

a motor; and a clutch assembly in driven relationship to the motor and in a driving relationship to the agitator for rotatably driving the agitator;

the clutch assembly comprising:

a clutch body;

a clutch plate having a friction pad and rotatably mounted to the clutch body;

a backing plate juxtaposed to the clutch plate in facing relationship thereto and rotatably mounted through the clutch body;

wherein the clutch plate and the backing plate are axially and rotationally movable with respect to one another between a first position wherein the clutch plate and backing plate are frictionally joined to one another, and a second position wherein the clutch plate and backing plate are separated from one another and rotationally shifted with respect to each other;

a spring mechanism configured to bias the clutch plate and the backing plate to the second position; and a clutch actuation mechanism aligned with the clutch plate and the backing plate to selectively move the clutch plate and the backing plate into the first position through relative rotation between the clutch plate and the backing plate;

wherein the clutch actuation mechanism comprises a lever arm which is positioned for manual actuation by a user for moving the clutch actuation mechanism between the two relative rotational and axial positions.

8. The vacuum cleaner according to claim 7 wherein the clutch actuation mechanism further includes complementary ramped surfaces which are rotationally related to one another to push the clutch plate and the backing plate into the first position in one relative rotational position of the ramps, and to move the clutch plate and the backing plate into the second position in another relative rotational position of the ramps.

9. The vacuum cleaner according to claim 7 and further comprising a resettable detent mechanism between the lever arm and the housing and configured to retain the lever arm in a rotational position corresponding to the first position of the clutch plate and backing plate.

10. The vacuum cleaner according to claim 9 wherein the resettable detent mechanism is a push-push detent.

11. The vacuum cleaner according to claim 7 wherein the clutch assembly is configured as a unitary module and is mounted to the housing as a unit.

12. A vacuum cleaner comprising a base assembly having a housing, a suction nozzle, and an agitator rotatably mounted to the housing;

a motor; and a clutch assembly in driven relationship to the motor and in a driving relationship to the agitator for rotatably driving the agitator;

the clutch assembly comprising:

a clutch body;

a clutch plate having a friction pad and rotatably mounted to the clutch body;

a backing plate juxtaposed to the clutch plate in facing relationship thereto and rotatably mounted through the clutch body;

wherein the clutch plate and the backing plate are axially movable with respect to one another between a first position wherein the clutch plate and backing plate are frictionally joined to one another, and a second position wherein the clutch plate and backing plate are separated from one another, a spring mechanism configured to bias the clutch plate and the backing plate to the second position;

a clutch actuation mechanism aligned with the clutch plate and the backing plate to selectively move the clutch plate and the backing plate into the first position;

wherein the clutch actuation mechanism includes complementary ramped surfaces which are rotationally related to one another to push the clutch plate and the backing plate into the first position in one relative rotational position of the ramps, and to move the clutch plate and the backing plate into the second position in another relative rotational position of the ramps.

13. The vacuum cleaner according to claim 12 wherein the complimentary ramped surfaces are positioned on juxtaposed faces of a lever cam and the clutch body.

14. The vacuum cleaner according to claim 13 wherein the clutch assembly further comprises a shaft which is rotatably mounted to the clutch body and the lever cam is rotationally mounted on the shaft.

15. The vacuum cleaner according to claim 14 wherein the clutch actuation mechanism comprises a lever arm which is positioned for manual actuation by a user for moving the lever cam between the two relative rotational positions.

16. The vacuum cleaner according to claim 15 and further comprising a resettable detent mechanism between the lever arm and the housing and configured to retain the lever arm in a rotational position corresponding to the first position of the clutch plate and backing plate.

17. The vacuum cleaner according to claim 12 wherein the clutch assembly is configured as a unitary module and is mounted to the housing as a unit.

18. The vacuum cleaner according to claim 12 wherein the clutch plate and the backing plate are conically shaped.

19. A vacuum cleaner comprising a base assembly having a housing, a suction nozzle, and an agitator rotatably mounted to the housing;

a motor; and a clutch assembly in driven relationship to the motor and in a driving relationship to the agitator for rotatably driving the agitator;

the clutch assembly comprising:

a clutch body;

a clutch plate having a friction pad and rotatably mounted to the clutch body;

a backing plate juxtaposed to the clutch plate in facing relationship thereto and rotatably mounted through the clutch body;

wherein the clutch plate and the backing plate are axially movable with respect to one another between a first position wherein the clutch plate and backing plate are frictionally joined to one another, and a second position wherein the clutch plate and backing plate are separated from one another, a spring mechanism configured to bias the clutch plate and the backing plate to the second position;

a clutch actuation mechanism aligned with the clutch plate and the backing plate to selectively move the clutch plate and the backing plate into the first position;

wherein the clutch assembly further comprises:

a shaft which is rotatably mounted to the clutch body;

the clutch body, the backing plate, the spring mechanism, and the clutch actuation mechanism are mounted on the shaft; and retainers mounted on both ends of the shaft;

wherein axial forces generated by compression of the spring mechanism when the clutch plate and backing plate are moved between the first and second positions are contained within the clutch assembly by the retainers, and the axial forces are isolated from the housing;

wherein the clutch actuation mechanism comprises a lever arm positioned for manual actuation by a user for moving the clutch actuation mechanism between the two relative rotational positions; and further comprising a resettable detent mechanism between the lever arm and the housing and configured to retain the lever arm in a rotational position corresponding to the first position of the clutch plate and backing plate.

20. The vacuum cleaner according to claim 19 wherein the resettable detent mechanism is a push-push detent.

* * * * *